US006401641B1

(12) United States Patent
Miyano

(10) Patent No.: US 6,401,641 B1
(45) Date of Patent: Jun. 11, 2002

(54) APPARATUS AND METHOD FOR PRODUCING A PATTERN ON A PIECE OF MATERIAL

(76) Inventor: Toshiharu Tom Miyano, c/o Miyano Machinery USA, Inc., 940 N. Central Ave., Wood Dale, IL (US) 60191

( * ) Notice: Subject to any disclaimer, the term of this patent is extended or adjusted under 35 U.S.C. 154(b) by 0 days.

(21) Appl. No.: 09/567,729

(22) Filed: May 10, 2000

(51) Int. Cl.[7] ..... D05B 21/00; D05B 27/14

(52) U.S. Cl. ..... 112/470.05; 112/470.06; 112/470.33

(58) Field of Search ..... 112/470.06, 470.04, 112/470.05, 470.29, 470.33, 63, 102.5, 475.08, 475.09, 475.18, 475.19, 470.07

(56) References Cited

U.S. PATENT DOCUMENTS 4,453,477 A * 6/1984 Gerber ..... 112/470.04
4,503,788 A * 3/1985 Giannuzzi et al. ..... 112/470.06
4,730,566 A * 3/1988 Brophy ..... 112/470.07
4,827,856 A * 5/1989 Rohr ..... 112/63
4,883,005 A * 11/1989 Wehmeyer ..... 112/63
5,271,347 A * 12/1993 Fontcuberta ..... 112/63 X
5,458,073 A * 10/1995 Harada et al. ..... 112/63
5,570,647 A * 11/1996 Adamski, Jr. ..... 112/470.31
6,135,038 A * 10/2000 Okamoto ..... 112/102.5

* cited by examiner

*Primary Examiner*—Peter Nerbun
(74) *Attorney, Agent, or Firm*—Wood, Phillips, Katz, Clark & Mortimer

(57) ABSTRACT

An apparatus for stitching a penetrable material. The apparatus has a support for material to be stitched and a head assembly with a stitching head capable of directing a thread carrying needle through the material to be stitched that is in an operable position on the support to thereby produce a pattern on the material in the operative position. The support has a surface against which a material to be stitched can be placed in the operative position. The surface on the support is movable relative to the stitching head around a first axis to thereby allow material in the operative position that is to be stitched to be repositioned relative to the stitching head.

20 Claims, 2 Drawing Sheets

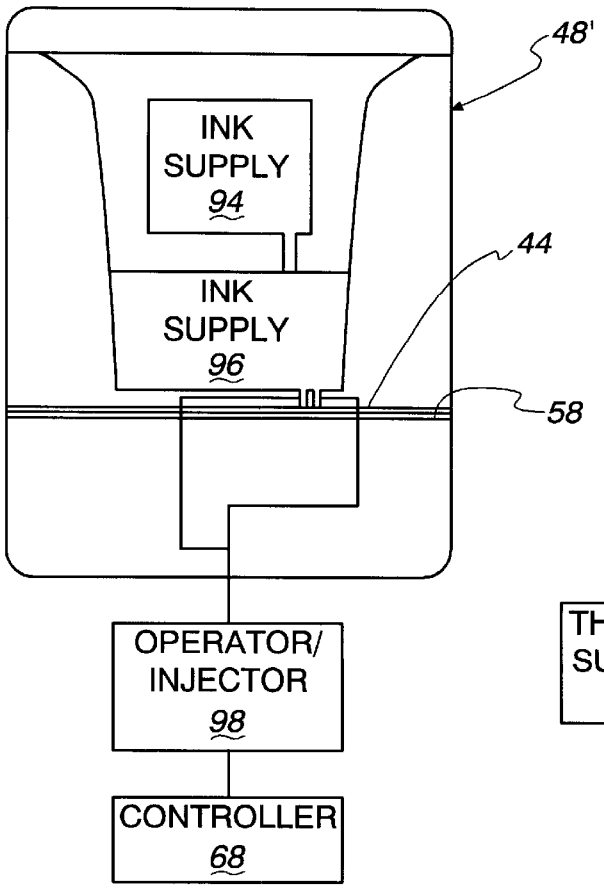
Fig. 4
Fig. 3
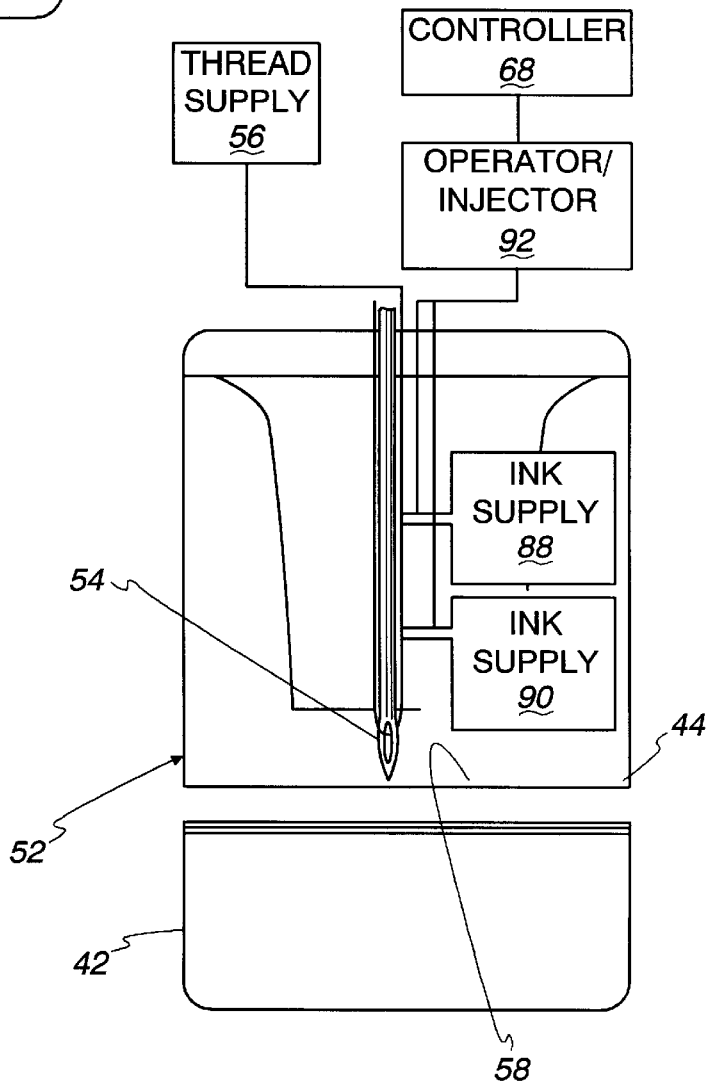

APPARATUS AND METHOD FOR PRODUCING A PATTERN ON A PIECE OF MATERIAL

BACKGROUND OF THE INVENTION

1. Field of the Invention

This invention relates to materials such as flexible fabrics, and the like, and, more particularly, to a method and apparatus for controllably producing a pattern on such material.

2. Background Art

It is well known to controllably produce patterns on flexible material such as cloth, paper, and the like, by stitching using various different colored threads, by the application of a paint or dye thereto, etc. In one form of stitching apparatus, a support is provided for the material in spaced relationship to a stitching head on a head assembly. The material is drawn taut within a continuous bow so that a surface on the material through which stitching is to be carried out resides substantially in a single X-Y plane within the bow perimeter. The stitching pattern is controlled by moving the material in the X-Y plane as the stitching head is operated.

While the above method is effective, it has some inherent drawbacks. The area available for stitching, at any one stage, is limited to that which can be accessed by the stitching head within the bow without interference with the bow.

Some products, by reason of their configuration, do not lend themselves to stitching by this method. For example, stitching on sleeves may be difficult or impossible to carry out by this method. It may not be possible to draw the sleeve taut to permit stitching through only one layer thereof.

Typically, formation of multi-color patterns using the above method requires that different color threads be separately used. This can be accomplished by serially performing stitching operations using separate stitching heads. Alternatively, the thread can be changed in a single stitching head which is operated to serially perform stitching operations.

Typically, this type of equipment has a controller which is pre-programmed to produce desired patterns. The controller may require specifically adapted software which is not usable with a personal computer.

SUMMARY OF THE INVENTION

In one form, the invention is directed to an apparatus for stitching a penetrable material. The apparatus has a support for material to be stitched and a head assembly with a stitching head capable of directing a thread carrying needle through the material to be stitched, that is in an operable position on the support, to thereby produce a pattern on the material in the operative position. The support has a surface against which a material to be stitched can be placed in the operative position. The surface on the support is movable relative to the stitching head around a first axis to thereby allow material in the operative position that is to be stitched to be repositioned relative to the stitching head.

The surface on the support may be convex and may extend through 360° around the first axis.

The surface on the support may be cylindrical.

In one form, the surface on the support is movable in first and second opposite directions relative to the stitching head substantially parallel to the first axis.

The stitching head may be movable relative to the support in first and second opposite directions in a line substantially orthogonal to the first axis.

In one form, the apparatus includes a drive for repositioning the surface of the support relative to the stitching head, a controller for operating the drive, and software for the controller that is PC-compatible.

Ink from a first supply of ink may be applied to the thread directed by the stitching head through the material to be stitched.

In one form, the first supply of ink has a first color. A second supply of ink with a second color may be provided such that the ink from the first and second supplies can be selectively applied to thread directed by the stitching head through the material to be stitched.

The invention is also directed to an apparatus for producing a pattern on a sheet of material having a support for material on which a pattern is to be produced, and a head assembly through which a pattern can be produced on material that is in an operative position on the support. The support has a surface against which a material can be placed in an operative position on the support. The surface on the support is movable relative to the head assembly around a first axis to thereby allow material in the operative position on which a pattern is to be produced to be repositioned relative to the head assembly.

The surface on the support may be convex and may extend through 360° around the first axis.

The surface on the support may be cylindrical.

In one form, the surface is movable in first and second opposite directions substantially parallel to the first axis.

The head assembly may be movable relative to the support in first and second opposite directions in a line substantially orthogonal to the first axis.

The apparatus may further include a drive for repositioning the surface of the support relative to the head assembly, a controller for operating the drive, and software for the drive that is PC-compatible.

A first supply of ink may be provided that can be applied to the material in the operative position on the support to produce a pattern on the material.

In one form, the first supply of ink has a first color and the apparatus includes a second supply of ink having a second color. Ink from the first and second supplies can be selectively applied to material to produce a pattern on the material.

The invention is also directed to a method of producing a pattern on material through a head assembly. The method includes the steps of providing a support with a surface, placing a piece of material against the surface of the support into an operative position, moving the support surface around the first axis, and producing a pattern through the head assembly on the piece of material as the piece of material is moved around the first axis.

The method may include the step, of moving the support surface substantially parallel to the first axis as a pattern is produced through the head assembly on the piece of material.

The method may further include the step of relatively moving the head assembly and support along a line substantially orthogonal to the first axis as the pattern is produced through the head assembly on the piece of material.

BRIEF DESCRIPTION OF THE DRAWINGS

FIG. 3 is an enlarged, schematic, cross-sectional view of a part of a head assembly on the apparatus in FIG. 2;

FIG. 4 is a view as in FIG. 3 of a modified form of head assembly, according to the invention.

DETAILED DESCRIPTION OF THE DRAWINGS

Figure 1:
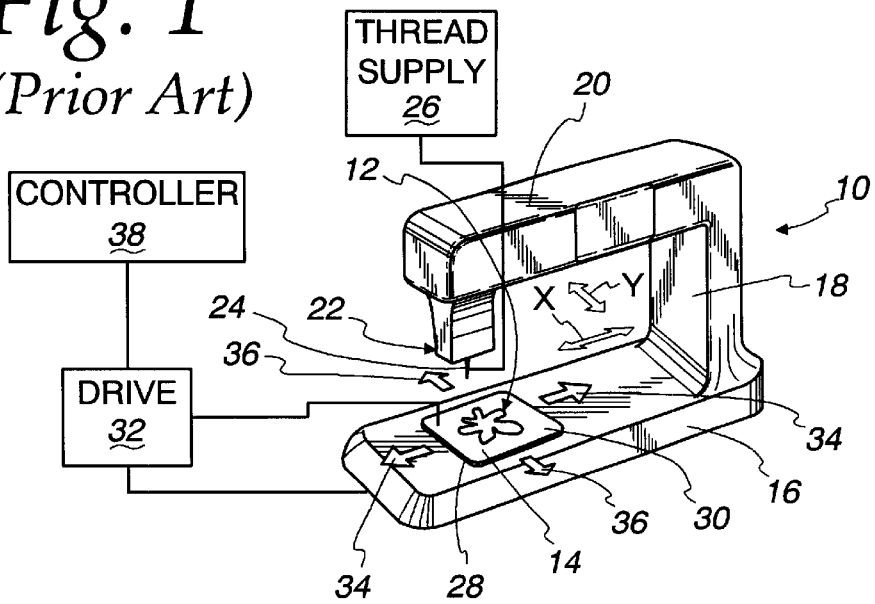
Fig. 1 (Prior Art)
FIG. 1 is a schematic, perspective view of a conventional apparatus for producing a pattern on a piece of material.

In FIG. 1, a conventional apparatus is shown at 10 for producing a pattern 12 on a piece of sheet material 14 which is readily penetrable by a needle. The sheet material 14 may be cloth, paper, or the like. The apparatus 10 consists of a support 16 which connects through an upright 18 to a head assembly 20. The head assembly 20 includes a stitching head 22 which is capable of reciprocatively driving a needle 24 to stitch thread from a supply 26 through the sheet material 14. The details of the stitching mechanism and stitching process are well known to those skilled in the art.

The sheet material 14 is drawn taut within the perimeter of a bow 28 so that a surface 30 thereon resides substantially within a plane. The bow 28 is shifted in a predetermined manner by a drive 32 back and forth along the X axis, as indicated by the arrows 34, and transversely back and forth along the Y axis, as indicated by the arrows 36. The movement of the drive 32 is dictated by a controller 38 that is operated by a dedicated software program. Various software programs with different pattern control can be purchased and interchanged.

Figure 2:
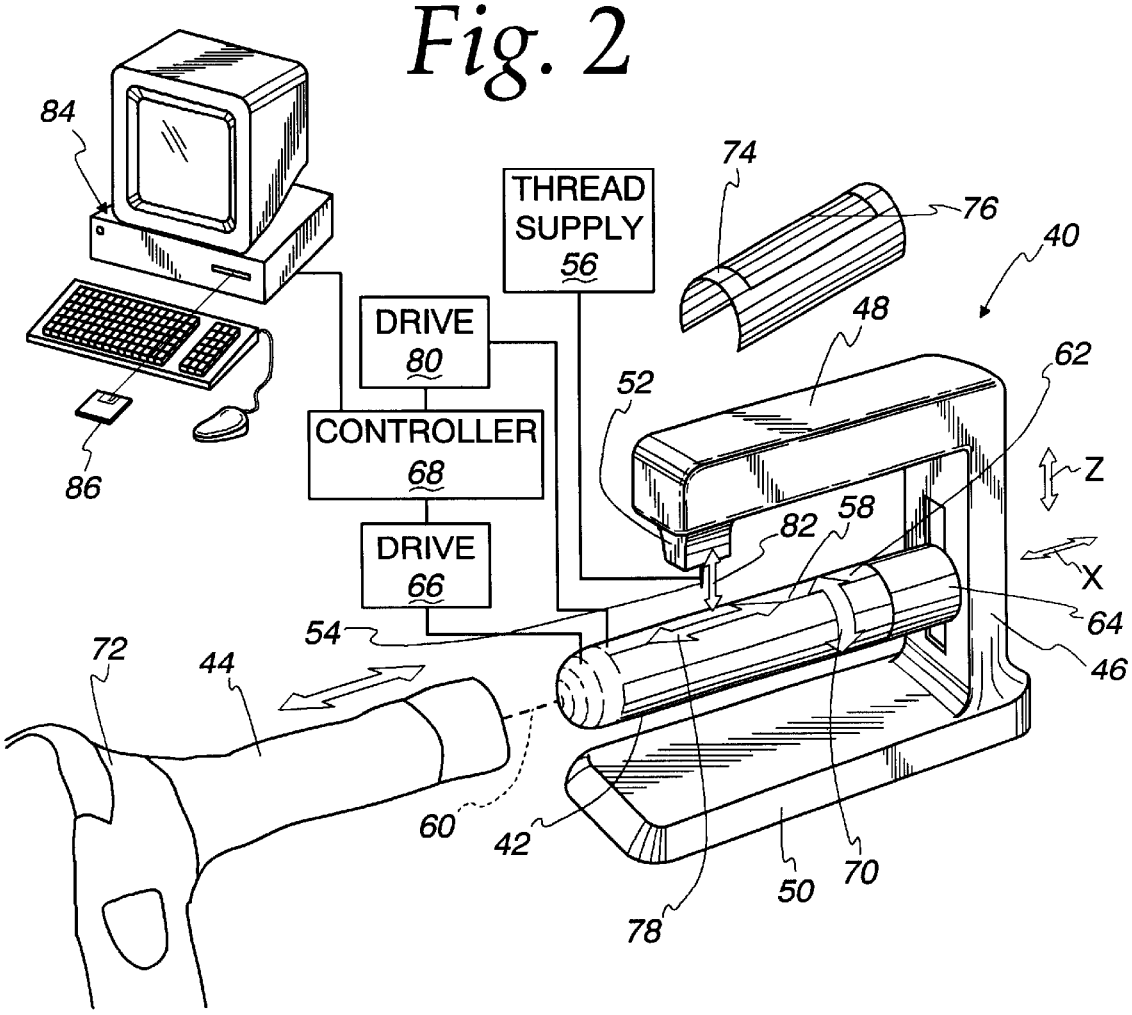
FIG. 2 is a perspective view of an apparatus for producing a pattern on a piece of material according to the present invention.

An apparatus for producing a pattern on a piece of material, according to the present invention, is shown at 40 in FIG. 2. The apparatus 40 consists of a support 42 for a piece of material 44 to be stitched. The support 42 projects in cantilever fashion from an upright 46 which connects between a head assembly 48 and a base 50 so that the upright 46, head assembly 48, and base 50 cooperatively define a frame.

The head assembly 48 consists of a stitching head 52 which reciprocates a thread carrying needle 54 along the Z axis in a sewing line. As in the prior art apparatus 10, the reciprocating movement of the needle 54 causes thread from a supply 56 to be stitched through the piece of material 44.

The support 42 has a convex surface 58 mounted for movement relative to the stitching head 52 around an axis 60 that is parallel to the X axis. The surface 58 can be mounted in any number of different ways to allow the necessary movement. In this case, an axial end 62 of the support 42 is journalled for rotation in a collar 64 on the upright 46. The support 42 can be suitably attached to the head assembly 48 and/or base 50 to permit the same movement.

The pivoting movement of the surface 58 around the axis 60 is effected by a drive 66 and is dictated by a controller 68. This movement is indicated by the double-headed arrow 70.

With the configuration shown, the piece of material 44 can be placed against the surface 58 in an operative position on the support 42. In this case, the piece of material 44 is a sleeve on a shirt 72. The configuration of the surface 58 lends itself to stitching on sleeves which can be placed surroundingly over the support 42, but is likewise suitable to facilitate stitching on flat material. In the form shown, the convex surface 58 extends through 360° around the axis 60, but could extend to a lesser degree.

In operation, the surface 58 is directed into the sleeve 44 and the sleeve material drawn taut thereagainst. The sleeve 44 can be suitable fixed by using a spring-type anchor 74 which extends conformingly through preferably in excess 180° around a part of the surface 58 and is grippingly held thereagainst. A spring type material made from metal, plastic, or the like may be used for the anchor 74. The anchor 74 preferably is dimensioned so that it must be expanded to be placed over the surface 58 such that upon being released it constricts and grips the surfaces 58 thereby maintaining itself in place. The anchor 74 has a working opening 76 therethrough within which a stitching area is defined.

Alternatively, the sleeve 44 can be accumulated and held so as to effectively reduce the diameter thereof to approximately that of the support 42, whereby the sleeve 44 closely embraces the support 42, thereby obviating the need to use a separate anchor 74 that frames the area to be stitched.

As a further alternative, one or more magnets can be used to captively hold the material against the support surface 58.

In operation, the controller 68 causes the drive 66 to strategically pivot the surface 58 around the axis 60 as the stitching head 52 operates the needle 54. In a preferred form, the surface 58 is also movable relative to the stitching head 52 along the X axis, as indicated by the double-headed arrow 78. A telescoping connection between the support 42 and collar 64 permits this guided movement, which may be generated by a separate drive 80, also operated by the controller 68. Other mechanisms could be devised for the X-axis movement. For example, guided sliding connection can be made between the support 42 and one or both of the head assembly 48 and base 50. A rack and pinion mechanism can be incorporated to effect the necessary movement of the surface 58.

Potentially, stitching can occur on substantially the entire axial extent of the surface 58 through approximately 360° around the axis 60. The controller 68 coordinates movement of the drives 66, 80 to produce the desired pattern as the stitching head 62 is operated.

It is also possible to connect the support 42 to the upright 46 and/or to the head assembly 48 and base 50 to allow the support 42 to be moved relative to the stitching head 52 in the direction of the Z axis, as indicated by the double-headed arrow 82.

In one form, the controller 68 may be operable through a personal computer 84 with PC-compatible software 86.

In FIG. 3, one form of stitching head 52 is shown in relationship to the support 42 with the surface 58 on which the piece of material 44 is in an operative position. The needle 54 draws the thread from the supply 56 in a predetermined path. Ink from a supply, and in this case two different supplies 88, 90, is caused to be selectively applied to the thread 56 from the supply by an operator/injector 92. The operator/injector 92 may cause ink from the supply 88 alone to be applied to the thread, ink from the supply 90 alone to be applied to the thread, or ink from both supplies 88, 90 to be applied simultaneously or serially to produce a desired color. This potentially obviates having to use multiple thread supplies 56 or may reduce the number of different thread supplies 56 required.

As one alternative, as shown in FIG. 4, the pattern 12 may be produced by the application of ink or other dye controllably directly against the piece of material 44. In this case, one or more ink supplies 94, 96 may be provided on a head assembly 20'. Through an operator/injector 98, ink from the supply 94 and/or supply 96 can be directed to against the piece of material 44 on the surface 58. The operators/injectors 92, 98 on the stitching head 52 and head assembly 48' may be operated by the controller 68 to coordinate the coloring of the thread from the supply 56 and the application of ink from the supplies 94, 96 with the movement of the surface 58.

The foregoing disclosure of specific embodiments is intended to be illustrative of the broad concepts comprehended by the invention.

What is claimed is:

1. An apparatus for stitching a penetrable material, said apparatus comprising:

a cantilevered support for material to be stitched; and a frame comprising an upright and a head assembly projecting from the upright so that the head assembly and upright cooperatively define an L shape;

the head assembly comprising a stitching head capable of directing a thread carrying needle in a sewing line through material to be stitched that is in an operative position on the support to thereby produce a pattern on the material in the operative position, said cantilevered support comprising a surface against which a material to be stitched can be placed in the operative position, said surface of the support movable relative to the stitching head around a first axis to thereby allow material in the operative position that is to be stitched to be repositioned relative to the stitching head, the sewing line extending through the support surface, the cantilevered support having axially spaced ends arranged so that a cylindrically-shaped workpiece fully separated from the cantilevered support can be directed over one axial end of the cantilevered support and slid toward the other axial end of the cantilevered support into the operative position as far as to the upright.

2. The stitching apparatus according to claim 1 wherein the surface on the support is convex.

3. The stitching apparatus according to claim 1 wherein the surface on the support is cylindrical.

4. The stitching apparatus according to claim 2 wherein the surface on the support is convex through substantially 360° around the first axis.

5. The stitching apparatus according to claim 1 wherein the surface on the support is movable in first and second opposite directions relative to the stitching head substantially parallel to the first axis.

6. An apparatus for stitching a penetrable material, said apparatus comprising:

a cantilevered support for material to be stitched; and a head assembly comprising a stitching head capable of directing a thread carrying needle in a sewing line through material to be stitched that is in an operative position on the support to thereby produce a pattern on the material in the operative position, said support comprising a surface against which a material to be stitched can be placed in the operative position, said surface of the support movable relative to the stitching head around a first axis to thereby allow material in the operative position that is to be stitched to be repositioned relative to the stitching head, the sewing line extending through the support surface, the cantilevered support having axially spaced ends arranged so that a cylindrically-shaped workpiece fully separated from the cantilevered support can be directed over one axial end of the cantilevered support and slid toward the other axial end of the cantilevered support into the operative position, wherein the stitching head is movable relative to the support in first and second opposite directions in a line substantially orthogonal to the first axis.

7. The stitching apparatus according to claim 1 further comprising a drive for repositioning the surface of the support relative to the stitching head, a controller for operating the drive, and software for the controller that is PC-compatible.

8. An apparatus for stitching a penetrable material, said apparatus comprising:

a cantilevered support for material to be stitched;

a head assembly comprising a stitching head capable of directing a thread carrying needle in a sewing line through material to be stitched that is in an operative position on the support to thereby produce a pattern on the material in the operative position, said support comprising a surface against which a material to be stitched can be placed in the operative position, said surface of the support movable relative to the stitching head around a first axis to thereby allow material in the operative position that is to be stitched to be repositioned relative to the stitching head, the sewing line extending through the support surface, the cantilevered support having axially spaced ends arranged so that a cylindrically-shaped workpiece fully separated from the cantilevered support can be directed over one axial end of the cantilevered support and slid toward the other axial end of the cantilevered support into the operative position; and a first supply of ink that can be applied to thread directed by the stitching head through material to be stitched.

9. The stitching apparatus according to claim 8 wherein the first supply of ink has a first color and further comprising a second supply of ink having a second color and ink from the first and second supplies can be selectively applied to thread directed by the stitching head through material to be stitched.

10. An apparatus for producing a pattern on a sheet of material, said apparatus comprising:

a support for material on which a pattern is to be produced; and a head assembly through which a pattern can be produced on material that is in an operative position on the support so that a location at which a pattern is produced on a material in the operative position resides directly between the head assembly and support surface, said support comprising a surface against which a material can be placed in the operative position on the support, the surface on the support movable relative to the head assembly around a first axis to thereby allow material in the operative position on which a pattern is to be produced to be repositioned relative to the head assembly, the surface on the support movable translatingly along first and second lines that are transverse to each other.

11. The apparatus for producing a pattern according to claim 10 wherein the surface on the support is convex.

12. The apparatus for producing a pattern according to claim 11 wherein the surface on the support is cylindrical.

13. The apparatus for producing a pattern according to claim 11 wherein the surface on the support is convex through substantially 360° around the first axis.

14. An apparatus for producing a pattern on a sheet of material, said apparatus comprising:

a support for material on which a pattern is to be produced; and a head assembly through which a pattern can be produced on material that is in the operative position on the support, said support comprising a surface against which a material can be placed in an operative position on the support, the surface on the support movable relative to the head assembly around a first axis to thereby allow material in the operative position on which a pattern is to be produced to be repositioned relative to the head assembly, the surface on the support movable translatingly along first and second lines that are transverse to each other, wherein the surface is movable in first and second opposite directions substantially parallel to the first axis.

15. The apparatus for producing a pattern according to claim 10 wherein the head assembly is movable relative to the support in first and second opposite directions in a line substantially orthogonal to the first axis.

16. The apparatus for producing a pattern according to claim 10 further comprising a drive for repositioning the surface of the support relative to the head assembly, a controller for operating the drive, and software for the drive that is PC-compatible.

17. The method of producing a pattern on material according to claim 1 further comprising an anchor which maintains a workpiece against the support surface.

18. The method of producing a pattern on material according to claim 17 wherein the anchor is a spring-type anchor that grips the support surface.

19. An apparatus for stitching a penetrable material, said apparatus comprising:

a cantilevered support for material to be stitched; and a head assembly comprising a stitching head capable of directing a thread carrying needle in a sewing line through material to be stitched that is in an operative position on the support to thereby produce a pattern on the material in the operative position, said support comprising a surface against which a material to be stitched can be placed in the operative position, said surface of the support movable relative to the stitching head around a first axis to thereby allow material in the operative position that is to be stitched to be repositioned relative to the stitching head, the sewing line extending through the support surface, the cantilevered support having axially spaced ends arranged so that a cylindrically-shaped workpiece fully separated from the cantilevered support can be directed over one axial end of the cantilevered support and slid toward the other axial end of the cantilevered support into the operative position, wherein the apparatus comprises a frame consisting of the stitching head, a base, and an upright connecting between the base and the stitching head and the cantilevered support is mounted on the frame for guided movement relative to the frame in a vertical direction transversely to the first axis.

20. The apparatus for stitching a penetrable material according to claim 19 wherein the cantilevered support is mounted on the upright.

* * * * *